US007020920B2

(12) United States Patent
Armstrong

(10) Patent No.: US 7,020,920 B2
(45) Date of Patent: Apr. 4, 2006

(54) POST OPERATIVE PATIENT ASSIST DEVICE

(76) Inventor: Rene Armstrong, 170 Briarwood, Christiansburg, VA (US) 24073

( * ) Notice: Subject to any disclaimer, the term of this patent is extended or adjusted under 35 U.S.C. 154(b) by 63 days.

(21) Appl. No.: 10/755,967

(22) Filed: Jan. 12, 2004

(65) Prior Publication Data

US 2004/0187215 A1 Sep. 30, 2004

Related U.S. Application Data

(63) Continuation-in-part of application No. 10/195,644, filed on Jul. 12, 2002, now Pat. No. 6,675,418.

(51) Int. Cl.
*A61G 7/053* (2006.01)
*A47C 21/00* (2006.01)

(52) U.S. Cl. ..... 5/662; 5/81.1 R

(58) Field of Classification Search ..... 5/662, 5/81.1 R; 294/152–156, 170; 16/428
See application file for complete search history.

(56) References Cited

U.S. PATENT DOCUMENTS

| | | | | |
|---|---|---|---|---|
| 2,843,858 | A * | 7/1958 | Bjorklund | 5/662 |
| 2,927,329 | A * | 3/1960 | Johannis | 5/662 |
| 3,957,574 | A | 5/1976 | Anderson | |
| 4,005,838 | A | 2/1977 | Grundy | |
| 4,177,542 | A * | 12/1979 | Denney | 24/115 R |
| 4,301,082 | A | 11/1981 | Adam | |
| 4,679,265 | A * | 7/1987 | Wicks | 5/662 |
| 4,791,702 | A * | 12/1988 | McVey | 16/428 |
| 5,106,826 | A | 4/1992 | Alford et al. | |
| 5,875,339 | A | 2/1999 | Molnar et al. | |
| 6,675,418 | B1 * | 1/2004 | Armstrong | 5/662 |

* cited by examiner

*Primary Examiner*—Michael Trettel
(74) *Attorney, Agent, or Firm*—James W. Hiney

(57) ABSTRACT

A post operative patient assist device comprising two sections, one designed to attach the device to a bed frame or the like, and the second section having a series of gripping members flexibly connected one to the other in series so as to provide a chain of grips for the patient to successively engage with his or her hands to as to allow him or her to raise themselves from a supine position to a sitting position or vice versa. The gripping members are made of a thermoplastic elastomer compound.

11 Claims, 7 Drawing Sheets

101
120
103
104
150
153
152
D
D
108
120
105
101
150
B
B
ABNOSTRAIN

162
SEE FIG. 11b
104
150
120
101
103
SEE FIG. 11a
101
101
160
150
161
150
161

POST OPERATIVE PATIENT ASSIST DEVICE

This application is a continuation-in-part of a case of the same title, POST OPERATIVE PATIENT ASSIST DEVICE, filed Jul. 12, 2002, Ser. No. 10/195,644, now U.S. Pat. No. 6,675,418, by the same inventor.

Patients who have had certain types of surgery focused on their abdominal region, such as appendicitis treatment, hysterectomies and caesarian deliveries, a few of the more common surgeries, have found that they have a great deal of difficulty in raising themselves in order to exit the bed, reach for an item near the foot of the bed, adjust their pillows for comfort and support, or to just sit up for awhile. These type of patients is on the rise with more than one in four women over 60 having hysterectomies and Caesarian deliveries accounting for approximately 23% of all deliveries these days. In addition, the number one injury to care givers at present is back injury incurred when attempting to assist patients rise from a sitting or supine position. With the hospital situation being what it is in these times, there simply are not enough nurses or aides handy to assist patients with most of their needs and when there are, there is usually a long wait after buzzing for one. Consequently, patients have to try and move themselves but the pain accompanying the post operative time period is so intense that they cannot just raise themselves up by bending the abdominal region quickly. To do so would also risk ripping out stitches and doing damage to the healing region. When nurses and aides assist them it is a very slow process to avoid damage to the area and to lessen the impact of the pain.

To solve this problem, various solutions have been proposed in the past but nothing has done the job in a way that allows the patient to control his or her ascent to the sitting position, is substantial so that even a large male can utilize it, is sufficiently secure to lessen any tendency of the patients hands to slip or to loose his or her grip due to lack of musculature in the hand or arms and that is adjustable to as to accommodate most people.

One such device is marketed by the Access With Ease company of Chino Valley, Ariz. which has a pull up strap consisting of a 40" loop which attaches around the leg or the bed frame and has 10" spacing in the strap. It essentially is a fabric ladder of sorts which relies on the patient to securely grip each transverse piece and pull themselves up. Naturally, this cannot be used secured to the patients leg if the patient has had surgery as that would exacerbate the pain and condition of the patient.

There are other, more grand devices such as patient lifts for lifting the patient either up or completely out of bed but these arrangements tend to be large, floor supported frames with a high lifting capacity and with swivels or rollers so as to swing the patient out and over the floor. These devices require a nurse or aide so that they are not patient initiated moves.

Another device that has been offered is a strap made of webbing that goes around the patient's foot who then attempts to pull themselves up. Of course, this does not work for most patients as it puts strain on the abdomen and thus defeats the very purpose of the device.

The instant invention is a vast improvement over the devices offered and/or utilized heretofore. It provides an easily stored, compact device which can be held in a storage area in a facility until a patient is in need of it.

The device is easily used by the patient and self-explanatory in terms of how each patient would employ it. It is fastened to the bed or bed frame or a portion thereof by a nurse or aide who then can leave the patient to his or her own inclination as to when to employ it. A patient may use it to lever them selves up to a sitting position as a final posture or to allow them to retrieve something or to allow them to then exit the bed from the side for attending to personal needs.

The device is made of material that in no way would harm the patient and with the use of non-slip handles it is not abrasive nor is it likely to impact the patient to produce bruising. The use of the material for the handles assures a firm grip that will not slip if the patient's hands become sweaty or are wet. The handle material assures a firm grip at all times and allows the patient to use both hands which, in elderly patients, is a big plus as their upper body and arm strength is usually diminished when compared to middle aged or younger patients.

The use of a hard central core in each hand piece assures a firm grip that will not be spongy thereby risking the patient losing control of the hand piece. The use of a plastic quick-release buckle assures an easy disconnect and the webbing content and size assures a sturdy device that will not fail or break.

Generally the device consists of a series of hand-pieces, which can be connected by eye-screws or the like screwed into individual wooden or plastic hand-pieces which are, in turn, covered with a no slip material. This material is thick enough to afford deflection by the fingers of the one gripping the hand-piece so that the lock of the grip is not affected by moisture or a minimum amount of strength in the patient's hand. Alternatively, the hand-pieces can be attached by fastening onto a length of cord which serves the same purpose as the swivels in allowing a flexible connection between the hand-pieces.

The series of hand-pieces, by which a patient gradually pulls himself or herself up hand over hand, is, in turn, connected by a plastic side release buckle to a continuous webbing which can be wrapped around a portion of the bed frame or some other secure anchorage. D-rings are used to connect the webbing to the eye-screw of the last hand-piece.

The preferred hand piece is made of a shape which has been developed after the filing of the prior application and is a hard plastic handle. It is made of polyhexamethylene-adipamide which is a type of nylon made by condensing hexamethylenediamine with adipic acid. The hand pieces are are overmolded and have a covering made of a thermoplastic elastomer which can be repeatedly stretched to at least twice their initial length with full rapid recovery. The webbing is made of polypropylene or nylon and the device uses plastic thread.

OBJECTS OF INVENTION

Therefore, it is an object of this invention to provide a secure, non-slip assisting device for post-operative abdominal patients whereby they can elevate themselves from a supine position to a sitting position in a bed.

It is another object of this invention to provide an assisting device for abdominal surgery patients, which has a series of non-slip hand-pieces, linked together by swivel connections so as to provide a series of sure gripping surfaces for the patient to raise himself or herself to a sitting position without assistance from another.

It is a further object of this invention to provide a assisting device for surgical patients, which allows them to hoist themselves to a sitting position and lower themselves back down without assistance from another.

It is yet another object of the invention to provide an assisting device for non-surgical individuals, which allow them to hoist themselves to a sitting position or to lower themselves to a reclining position without assistance from another.

It is a still further object of this invention to provide a series of linked gripping members connected to a bed attachment strap, which will allow post operative patients to raise themselves slowly to a sitting position without assistance thereby insuring that they do not injure themselves or cause injury to another in trying to raise them.

It is yet another object of this invention to provide linked gripping members on a bed strap which are made of polyhexamethyleneadipamide.

Still another object is to provide gripping members which have a unique shape and constriction of Nylon 6/6 and which are covered with a thermoplastic elastomer compound covering.

These and other objects will become apparent when reference is had to the accompanying drawings in which FIG. 1 is a top view of the first portion of this invention showing the grip members, and FIG. 2 is a top view of the strap portion of the invention showing the buckle and FIG. 3 is a side view of the invention showing the interconnection of the various portions, and FIG. 4 is a cut away view of one of the gripping members of FIGS. 1 and 2, FIG. 5 is a side view of a second embodiment of the invention 51.

FIG. 9 is a series of view of the hand piece of this invention with:

Figure 9A:
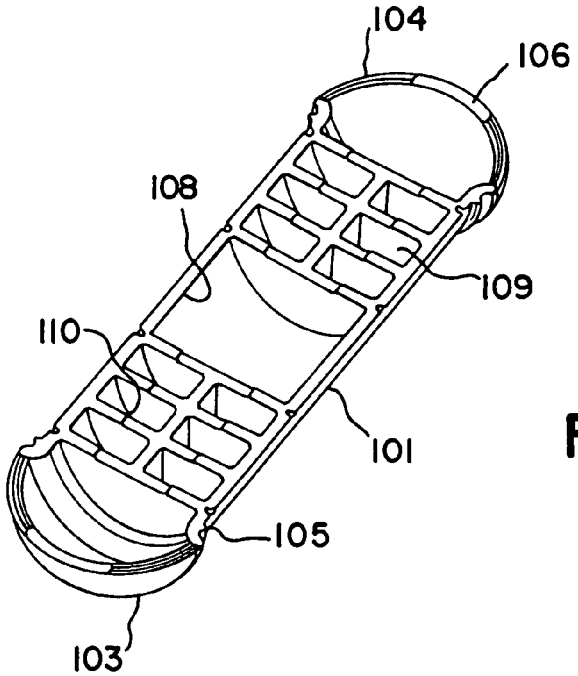
Figure 9B:
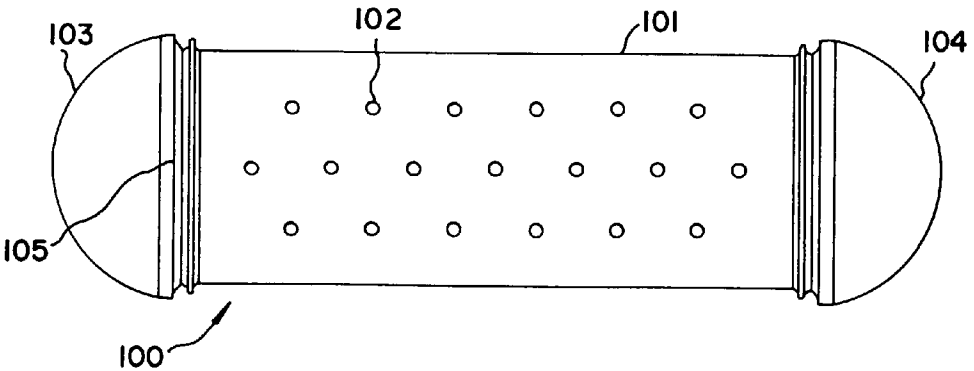
Figure 9C:
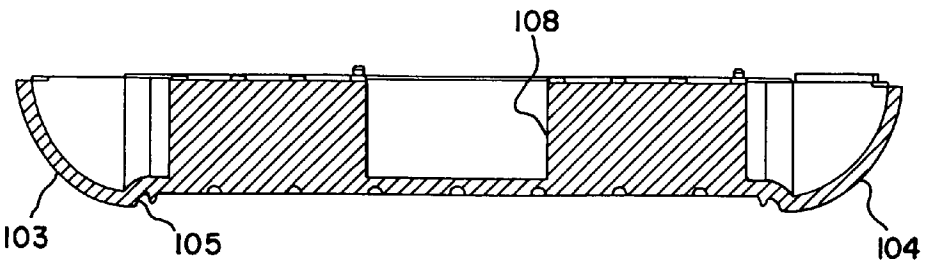
Figure 9D:
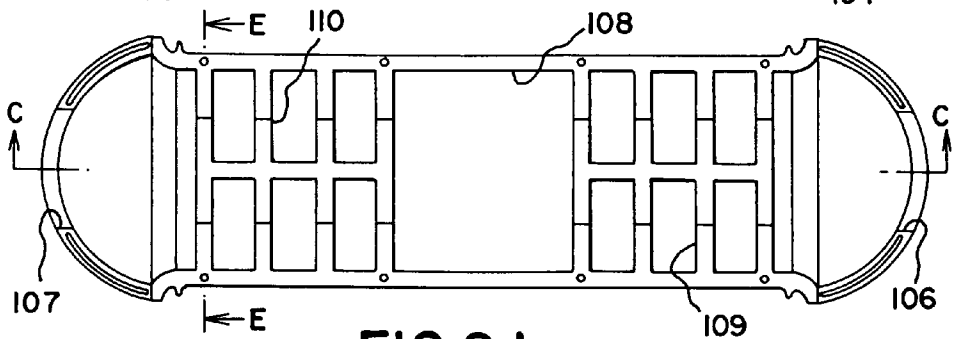

FIG. 9*a* showing the hand piece in three dimensional cross sectioned view,

FIG. 9*b* showing the top view of the hand piece,

FIG. 9*c* is a cross-sectional view of the device shown in FIG. 9*d*, taken along line C—C thereof.

Figure 10E:
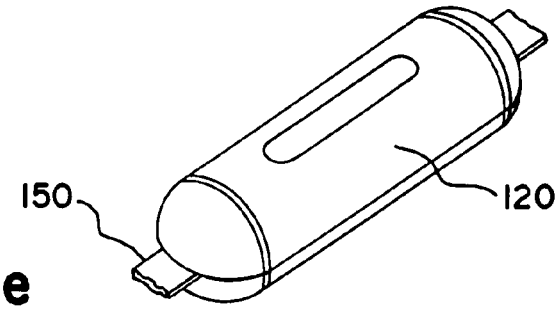
Figure 10D:
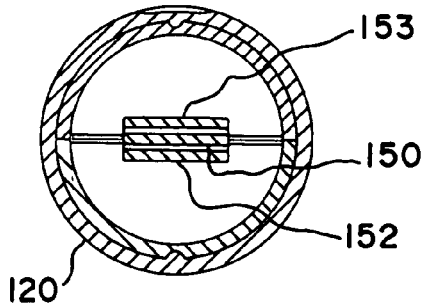
Figure 9E:
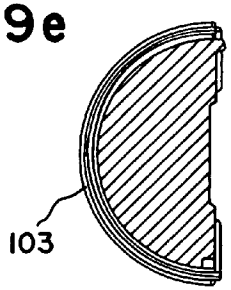
Figures 10A, 10B, 10C:
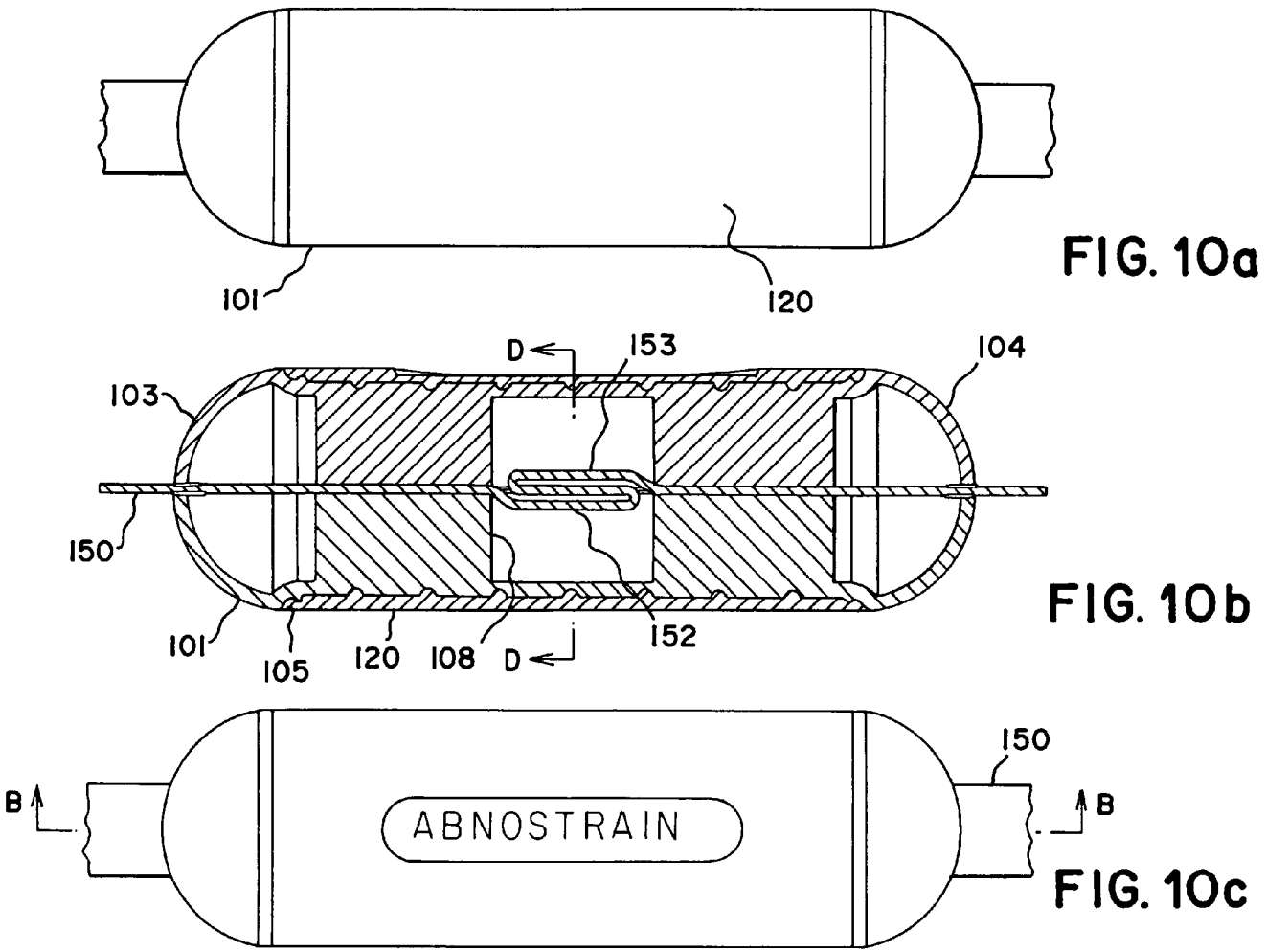

FIG. 9*d* showing the plan view of the device shown in FIG. 9*a*,

FIG. 9*e* is a cross-sectional view of the device shown in FIG. 9*d* taken along line E—E thereof, FIG. 10 shows the hand piece assembled with;

FIG. 10*a* showing the bottom view thereof,

FIG. 10*b* showing a cross-sectional view of the piece of FIG. 10*c* taken along line B—B thereof, FIG. 10*c* showing the top or front view of the device of FIG. 10*a*, FIG. 10*d* showing a cross-sectional view of the piece of FIG. 10*b* taken along line D—D thereof.

FIG. 10*e* showing a perspective view of the hand piece.

Figures 11, 11A, 11B, 12:
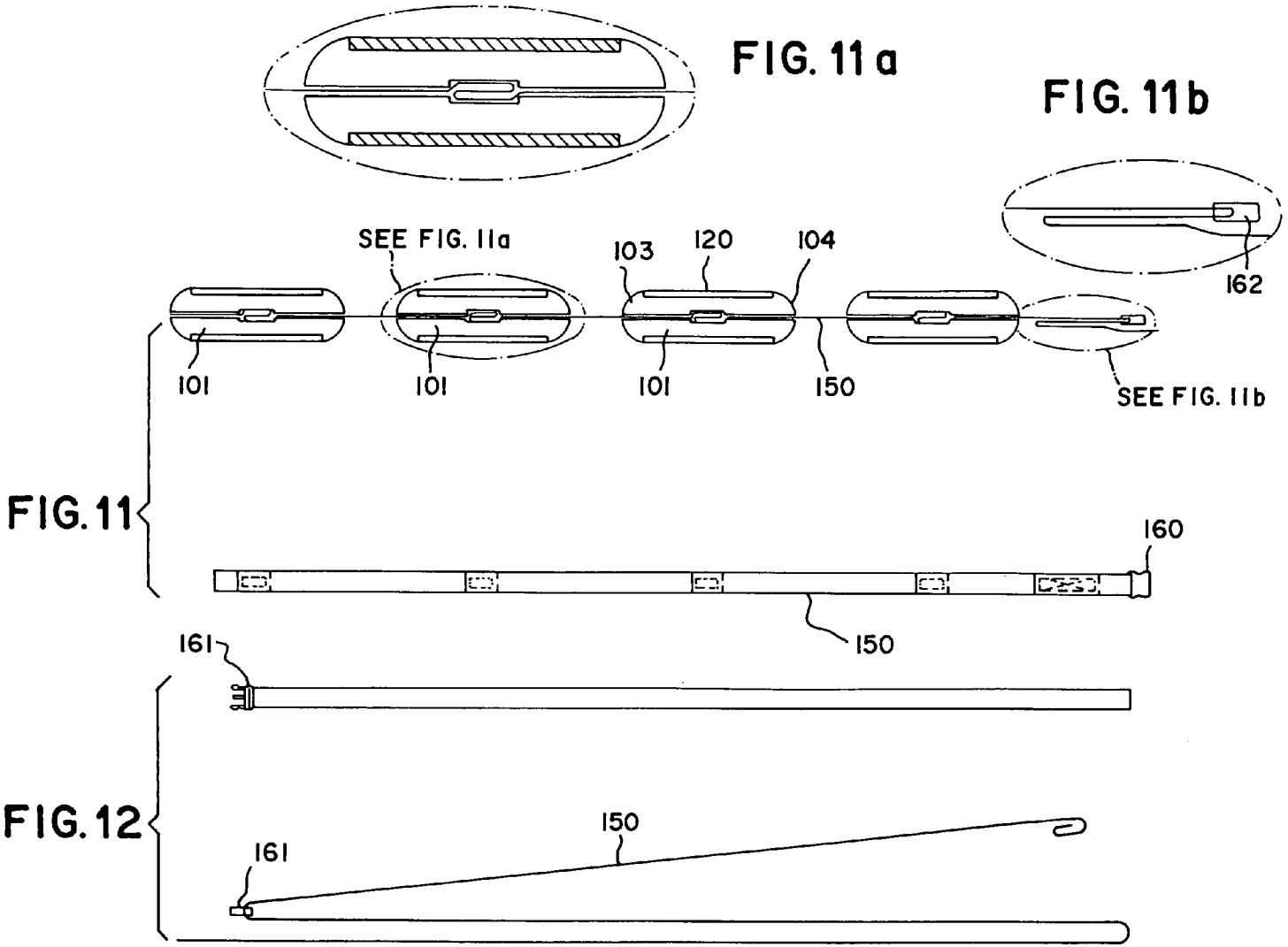

FIG. 11 is a representative view of the interaction of the strap and the hand pieces used by the patient.

FIG. 11*a* is an exploded view of the hand piece showing the fold of the strap therein, FIG. 11*b* is an exploded view of the hand piece showing the buckle arrangement.

FIG. 12 is a side view of the strap and its construction.

Figure 1:
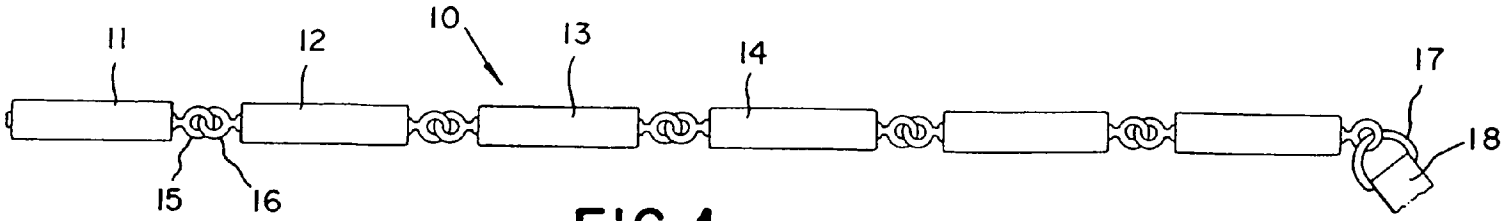
Figure 2:
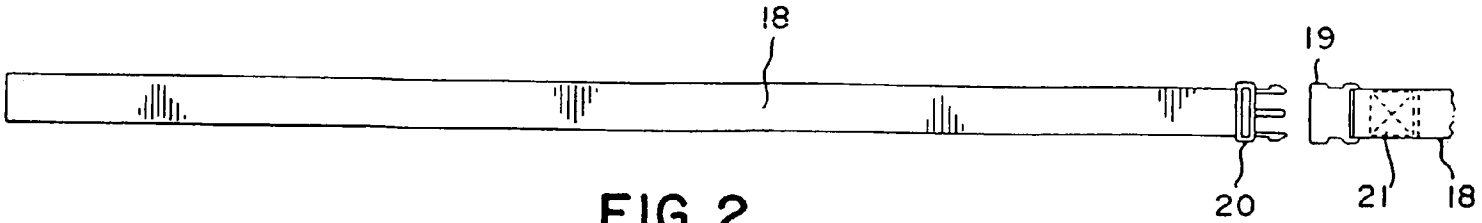
Figure 3:
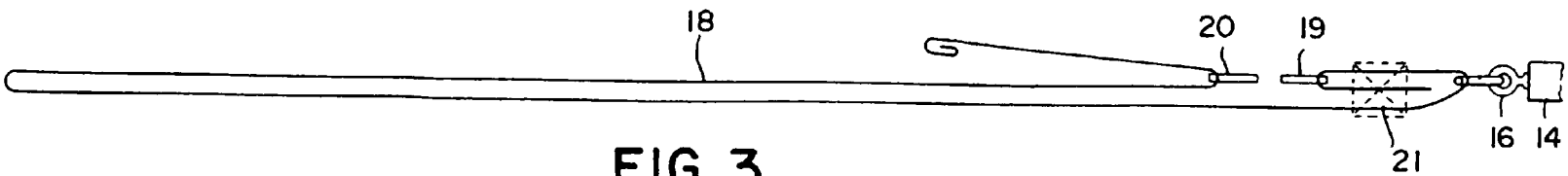
Figure 4:
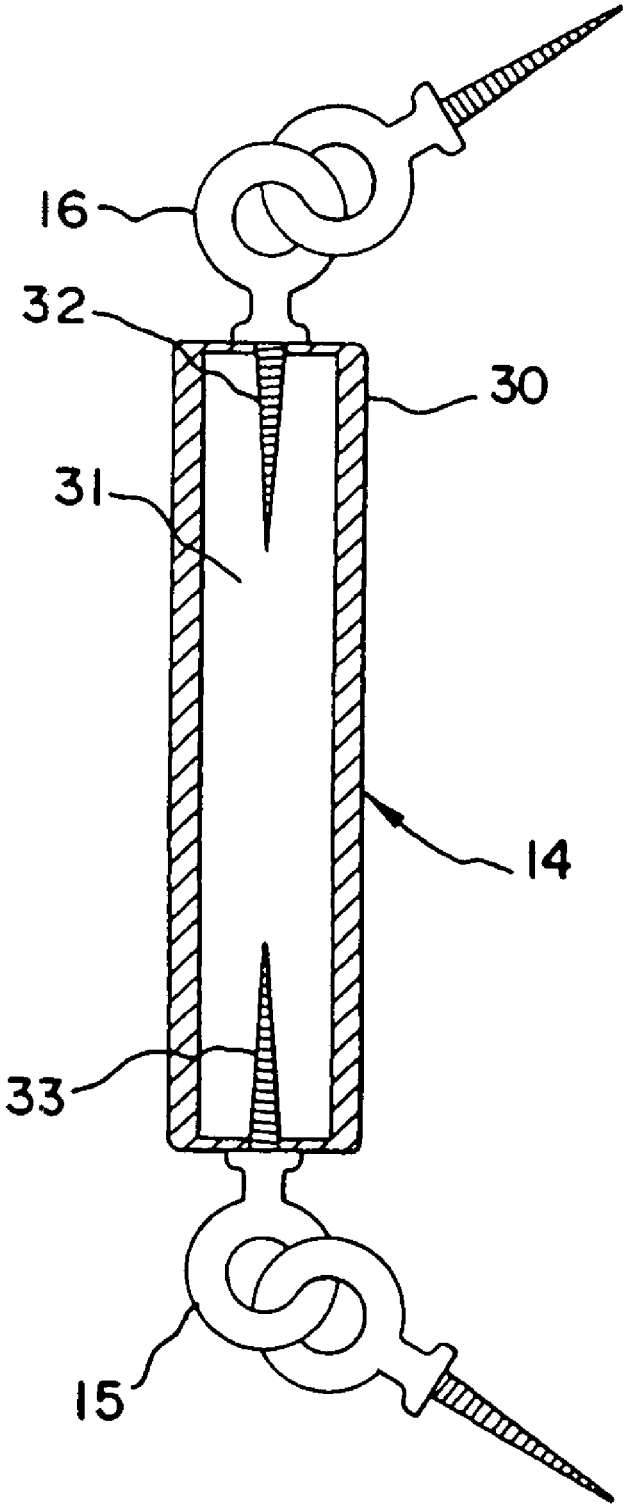
Figure 5:
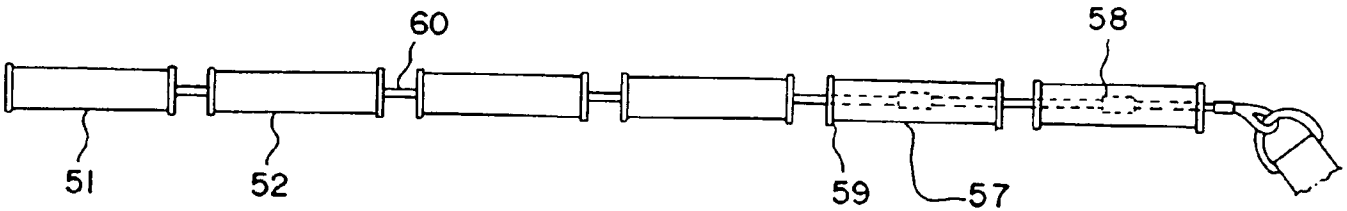
Figure 6:
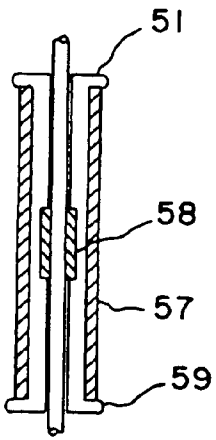
FIG. 6 is a sectional view of a typical hand-piece of the second embodiment.
Figure 7:
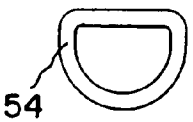
FIG. 7 shows a typical D-ring for securing the device together.
Figure 8:
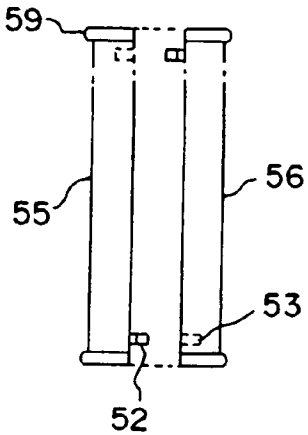
FIG. 8 shows a typical hand-piece of the second embodiment pulled apart.

Referring to FIG. 1 there is shown the device, 10, having a series of gripping members 11 through 14, which are linked together by, metal eye screws 15, 16 and which are connected at one end to a strap 18 via link 17. On strap 18 are buckle members 20 and 21, which snap together, and one of which has an adjustment portion 21 for adjusting the length of the strap. A user has the strap secured on an end of the bed and by pulling hand over hand on the gripping members or hand-pieces 11 and so on will gradually pull himself or herself up to a sitting position. Alternatively, the user may use the device to lower herself or himself to a supine position.

FIGS. 5 through 8 show a second embodiment 50 of the invention where the hand-pieces 51, 52, etc. are made of two plastic parts 55, 56, having male portion 52, and female portion 53 which snap together to surround a nylon cord 60. Each hand-piece or gripping member has a covering of a non-slip material 57 such as gel which affords a user a secure grip despite such factors as sweat or wet hands. Thus, the user is guaranteed a secure grip and does not have to worry about slipping due to moisture in one's palm. Within the two portions 55, 56 of a typical hand-piece is a crimp 58 which is used to crimp the hand-piece against slippage on cord 60. D-rings such as 54 afford a connection between the cord and the webbing of the invention. The hand-pieces have a lip 59 which keeps the gripping material 57 in place on each hand-piece or gripping member. Thus is it seen how a user may grip each successive hand-piece and pull them selves up to a sitting position or, conversely, lower themselves to a supine position. The device is flexible, easy to store and lightweight. The use of the successive gripping members with non-slip surfaces allow the user to obtain a firm grip and not have any portion of the gripping members cut into their palm or cause pain. The use of Nylon in the strap portion and the cord allows for an inexpensive material to be used and for strength which is important if the user is a large person.

Of course, the gripping members and cord may be molded as one piece by existing techniques and the strap can be molded as one piece with the cord portion. The use of plastics can be substituted for wood and other plastics used in lieu of Nylon and those mentioned herein. The molded gripping members can be treated to provide non-slip surfaces thereon which will act in the same way as the non-slip coverings shown and described such as gel.

FIGS. 9 through 12 show the preferred embodiments of the hand piece as developed over the time since the original filing of the application. FIG. 9 shows the main hand piece 100 having a cylindrical main portion 101 with apertures 102 therein. It has spherical end pieces 103 and 104 which have rectangular holes therein for a strap 150. The interior has a central chamber 108 which is designed to accommodate the folds 152, 153 area of the strap 150. There is a plurality of chambers such as 109 and 110 within the main structure of each hand piece. The piece has a covering 120, as shown in FIG. 10 wrapped around it so that a user can engage the piece without it slipping from his or her grip. Covering 120 is made of a thermoplastic elastomer compound which is highly resilient and can be repeatedly stretched but recovers it initial form. This covering atop the Nylon handle piece, 101, allows a user to grip the hand piece securely and insures a non-slip grip thereon. The rounded shape of the grip is also designed to allow the user to firmly grip the piece which has its non-slip covering 120. The actual material used for the covering is a thermoplastic elastomer such as Dynaflex® TPE compound made by GLS Corporation, Thermoplastic Elastomer Division or Santoprene® rubber 111-35 made by Advanced Elastomer Systems. These type of materials were found to afford the best gripping for a user and is used on each covering 120 on each piece 101. The strap 150 is a polypropylene or nylon webbing approximately ⅝ inches in width. Buckle 160 is a standard release buckle as found on many snap buckle applications which has a male 161 and female counterpart 162. Other thermoplastic elastomers which provide a soft gripping function, as opposed to a hard rigid surface, which allows for slippage, may be used. The object is to provide a surface that gives and is soft to provide a firm purchase on the gripping members to prevent slippage due to low friction or perspiration of the user's hand.

While only three embodiments of the invention have been shown and described, it will be obvious to those of ordinary skill in the art that many other changes and modification and embodiments may be fashioned without departing from the scope of the appended claims.

The invention claimed is:

1. A self-assisting post surgical device for patients that have had some type of surgery which affects the abdominal region which allows them to gradually raise themselves from a supine position to a sitting position and vice-versa, said device comprising a first gripping section having a series of individual cylindrical members flexibly and coaxially linked together so as to allow a user to haul himself or herself up to a sitting position by grasping, consecutively, said individual members and pulling oneself upright, a second section of said device having an adjustable portion thereof whereby the device may be anchored on a patient's bed or portions thereof to provide a firm attachment, and said second section being flexibly attached to said first gripping section, said first gripping section comprising a series of hand pieces linked together by a strap, said members affixed to said strap by securing a fold section on said strap, said members being of a molded nylon composition and having spherical end portions.

2. A device as in claim 1 wherein each said member is a hollow, generally cylindrical portion with a non-slip gripping surface sleeved thereon or coated thereon, said gripping surface being compressible by the hands of a user so as to allow a firm grip, said members each having at least one chamber therein to allow for compressibility of the member by the user grasping said gripping surface.

3. A device as in claim 1 wherein said members are made of polyhexamethyuleneadipamide.

4. A device as in claim 2 wherein said device includes identical members linked together by the second section of the device which comprises a polypropylene or nylon webbing strap, said strap having folds which are accommodated by the chambers within said members.

5. A device as in claim 1 wherein said second section of said device comprises a Nylon strap which can be looped around portions of a patient's bed to secure said device thereto and said gripping portion is made of a thermoplastic elastomer.

6. A device as in claim 5 wherein said strap has a male and female buckle system for securing it around the end portion of a bed.

7. A device as in claim 6 and including a plastic snap buckle having an adjustment means thereon on said strap so the length of said strap may be adjusted and be quickly detached from the portion of a bed.

8. A medical aid for assisting users who do not have the abdominal strength to raise themselves from a supine position or vice-versa, said aid comprising a first portion having a series of elongated cylindrical hand grip members connected one to the other in series, said connection allowing for twisting movement and to provide a user with means to pull said aid, grip by grip, toward themselves, to raise themselves, said members being connected coaxially.

a second portion having a strap portion adapted to be secured to a bed or other permanent structure so as to anchor one end of the aid against movement, thereby allowing the gradual pulling of said grip members by a user to raise said user to a sitting or standing position or vice-versa, said hand grip members comprising a series of identical cylindrical members which have apertures at each end designed to accommodate the strap portion of said second portion and to affix each said member to said strap portion, and said members being made of a form of molded Nylon with a gripping coating or sleeve made of a thermoplastic elastomer fitted thereon to allow the user to firmly grip the members.

9. An aid as in claim 8 wherein said grip members are elongated and have a thermoplastic elastomer gripping surface thereon so as to allow the user to maintain a grip thereon without slipping off and have a hollow chamber within.

10. An aid as in claim 9 wherein said hand grip members are compactible foam.

11. An aid as in claim 9 wherein said hand grip members are made of rubber material.

* * * * *